US008887457B1

(12) United States Patent
Knight

(10) Patent No.: US 8,887,457 B1
(45) Date of Patent: Nov. 18, 2014

(54) DOOR FRAME REINFORCEMENT ASSEMBLY

(71) Applicant: Brian M. Knight, New Orleans, LA (US)

(72) Inventor: Brian M. Knight, New Orleans, LA (US)

( * ) Notice: Subject to any disclaimer, the term of this patent is extended or adjusted under 35 U.S.C. 154(b) by 0 days.

(21) Appl. No.: 13/895,347

(22) Filed: May 15, 2013

(51) Int. Cl.
*E06B 1/04* (2006.01)
*E06B 5/11* (2006.01)
*E06B 1/52* (2006.01)

(52) U.S. Cl.
CPC .. *E06B 5/113* (2013.01); *E06B 1/52* (2013.01)
USPC ..... 52/210; 52/656.4; 52/717.01; 49/504

(58) Field of Classification Search
USPC ..... 52/210, 211, 212, 213, 215, 216, 204.1, 52/656.4, 717.01; 49/504
See application file for complete search history.

(56) References Cited

U.S. PATENT DOCUMENTS 3,287,856 A * 11/1966 Passovoy ..... 49/504
3,345,780 A * 10/1967 McGhee ..... 49/504
3,423,897 A * 1/1969 Birum, Jr. ..... 52/773
3,591,985 A * 7/1971 Coppins ..... 49/504
3,774,345 A * 11/1973 Cole et al. ..... 49/504
3,815,945 A * 6/1974 Lamphere ..... 292/340
4,295,299 A * 10/1981 Nelson ..... 49/504
4,660,338 A * 4/1987 Wagner ..... 52/232
5,058,323 A * 10/1991 Gerritsen ..... 49/504
5,182,880 A * 2/1993 Berge et al. ..... 49/504
5,669,192 A * 9/1997 Opdyke et al. ..... 52/211
5,836,118 A * 11/1998 Thornton et al. ..... 52/204.1
5,934,024 A * 8/1999 Simpson ..... 49/462
6,178,700 B1 * 1/2001 Mayer, Jr. ..... 49/504
6,295,779 B1 * 10/2001 Canfield ..... 52/656.4
7,134,246 B1 * 11/2006 Olberding et al. ..... 52/210
7,204,059 B2 * 4/2007 Schiffmann et al. ..... 52/211
7,467,818 B2 * 12/2008 Young ..... 292/341.14
7,472,519 B2 * 1/2009 Careri ..... 52/210
8,713,866 B2 * 5/2014 Gadoury ..... 52/211
2008/0284182 A1 * 11/2008 Canerdy, Jr. ..... 292/346
2009/0255197 A1 * 10/2009 Chapman ..... 52/210
2010/0199580 A1 * 8/2010 Park ..... 52/210
2011/0179730 A1 * 7/2011 Kolovich et al. ..... 52/204.2

FOREIGN PATENT DOCUMENTS

DE 3347321 A1 * 7/1985 ..... E06B 1/34

* cited by examiner

*Primary Examiner* — Brent W Herring
(74) *Attorney, Agent, or Firm* — Keaty Law Firm, LLC

(57) ABSTRACT

A door frame reinforcement assembly for resisting an intrusive force applied to a building door has a pair of opposing elongated jamb members and elongated reinforcement members securable with a respective jamb member. Each of the jamb members has a pair of rabbet milled step-up cutouts. One of the cutouts receives a long screw threadably engaging the jamb member with the walls studs. The reinforcement members are secured within the second cutout. The reinforcement members are formed as metal tubes with an insert.

22 Claims, 6 Drawing Sheets

DOOR FRAME REINFORCEMENT ASSEMBLY

BACKGROUND OF THE INVENTION

This invention relates to a door assembly for installation into a house or building, and, more particularly, to reinforcement assembly for door jambs designed to reduce the risk of intrusion through the door.

According to some statistics, more than two million homes are burglarized each year. The majority of all burglary attacks are on residential property; two-thirds of these are through a primary entryway. Intruders often gain access to a building through an exterior door. Often, this act involves kicking the door in, breaking the door jambs or separating the door from its frame. Usually, if a burglar cannot make it into the building in one or two minutes, he will just move onto the next one. In order to slow an intruder it is therefore important to keep the doors and windows locked.

However, this basic technique may not be sufficient to prevent an amateur burglar from trying to access the building by force. In-swinging door assemblies can be attacked and easily forced due to the brittle nature of wood, plastic, or composite (WPC) jambs. The jamb failure can occur at both the strike (lock) side of the door and at the hinge side of the door.

Many buildings are constructed using flimsy strike plates. The strike plate is the metal plate that surrounds the lock set (the hole in the door frame where the lock bolt enters). Even though it is advisable to have 3-inch screws securing heavy-duty strike plates, many homes are built with lower quality strike plates or have strike plates that are secured with shorter screws that only attach to the door jamb, not the underlying stud. After-market, surface-mount hardware, such as larger strike plates are helpful but can cause jamb failure due to deflection of fasteners used in their installation. Strike side surface-mount hardware does not address attacks to the hinge side of the door assembly.

Even with a strong door and quality, properly-installed locks, a burglar may be able to gain entry by breaking or prying the door frame itself. Most door frame moldings are simply tacked to the wall, so a crowbar or a solid kick can easily separate the frame from the wall. There exists therefore a need for a simple an inexpensive modification of a door frame assembly that will significantly reinforce the door and deter would-be burglars.

The present invention contemplates elimination of drawbacks associated with conventional door frame construction and provision of a reinforced door frame assembly.

SUMMARY OF THE INVENTION

It is, therefore, an object of the present invention to provide a reinforced door assembly.

It is another object of the invention to provide a door frame design that improves the latching and locking engagement of the door with the building structure framework.

It is a further object of the invention to provide a reinforced door frame assembly that significantly increases resistance of the door when an impact load is exerted against the exterior of the door.

It is still a further object of the invention to provide a door reinforcement assembly that secures the door at both the hinge and the lock sides.

These and other objects of the invention are achieved through a provision of an assembly for reinforcing a door fitted in an opening formed in a building having vertical wall studs. The assembly is arranged to resist an intrusive force applied to the door. The assembly comprises a pair of elongated jamb members mountable lengthwise along a hinge side and strike (lock) side of the door. Each jamb member is formed with a first cutout and a second cutout adjacent the first cutout. The first cutout defining a first raise stop and the second cutout defines a second raise stop. The jamb members are securable to the wall studs of the building by receiving a long threaded fastener extending from the first cutout into the wall studs of the building.

A first metal elongated tubular reinforcement member is securable within the second cutout of each of the jamb members. An insert is fitted into the hollow tubular member. Frame clips secure the jamb members with the reinforcement members.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
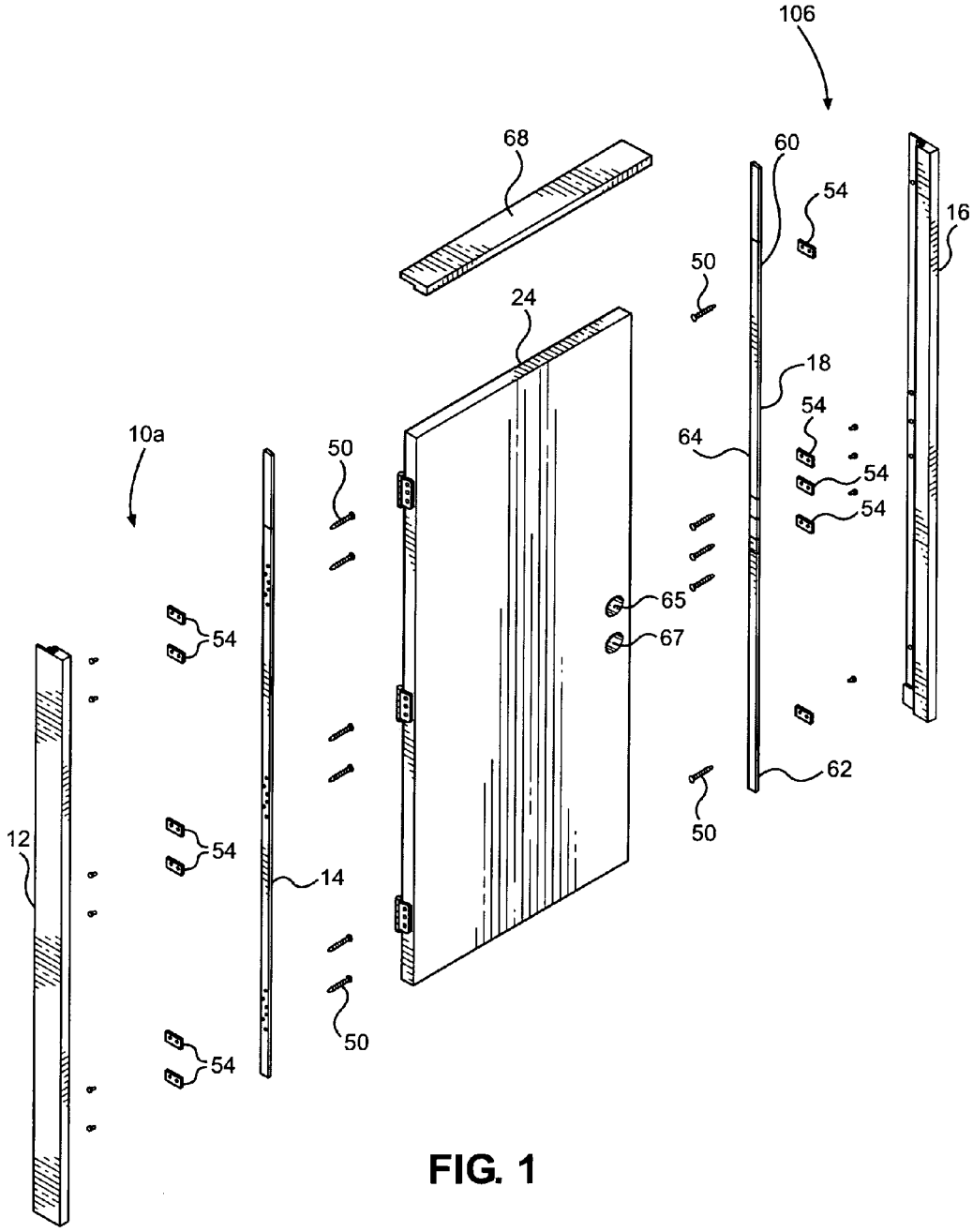
FIG. 1 is an exploded view of the door frame assembly according to the present invention.

Turning now to the drawings in more detail, numeral 10 designates the door frame assembly according to the present invention, with numeral 10*a* designating a hinge side subassembly and numeral 10*b* designating the strike side subassembly. The hinge side subassembly 10 comprises an elongated hinge side door jamb member 12 and an elongated hinge side reinforcement member 14. The subassembly 10*b* comprises a strike side door jamb member 16 and an elongated strike side reinforcement member 18. The hinge side jamb member 12 is a minor image of the strike side jam member 16, and the hinge side reinforcement member 14 is a minor image of the strike side reinforcement member 18.

The hinge side jamb member 12 differs from the strike side jamb member 16 in the number of securing fasteners securing the jamb member to the reinforcement member. The hinge side reinforcement member 14 differs from the strike side reinforcement member 18 by the number of securing fasteners and the number of frame clips secured to the reinforcement member, as will be described in more detail hereinafter.

Figure 4:
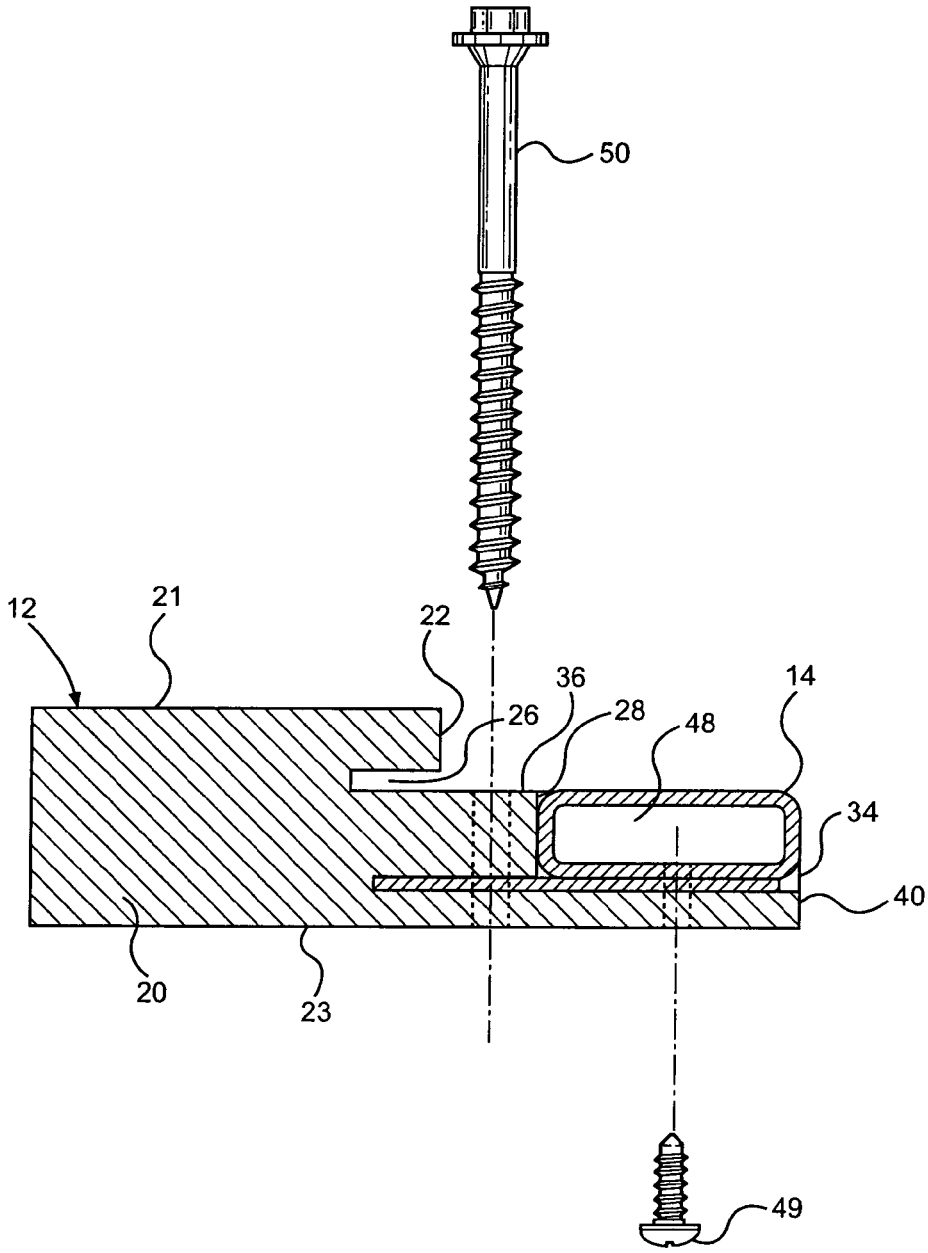
FIG. 4 is a detail cross-sectional view of the door jamb engaged with the reinforcement member.
Figure 5:
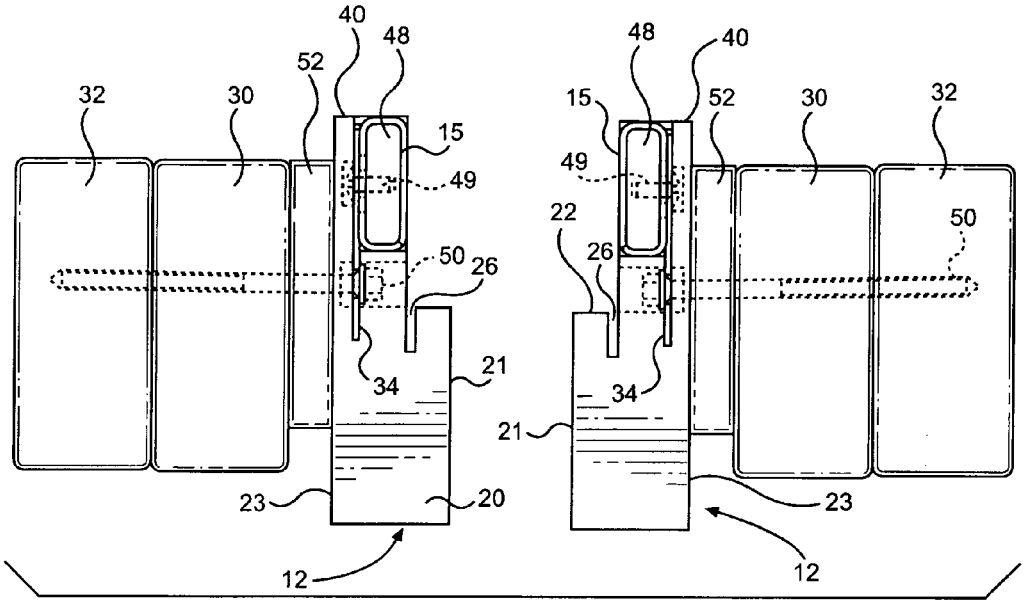
FIG. 5 is a sectional view of the door frame assembly engaged with the wall studs.
Figure 6:
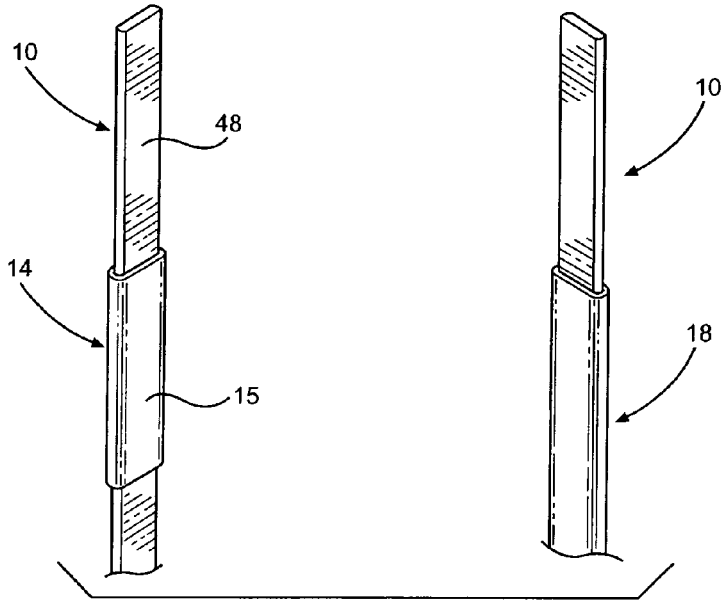
FIG. 6 is a detail view illustrating the reinforcement members with inserts.
Figure 7:
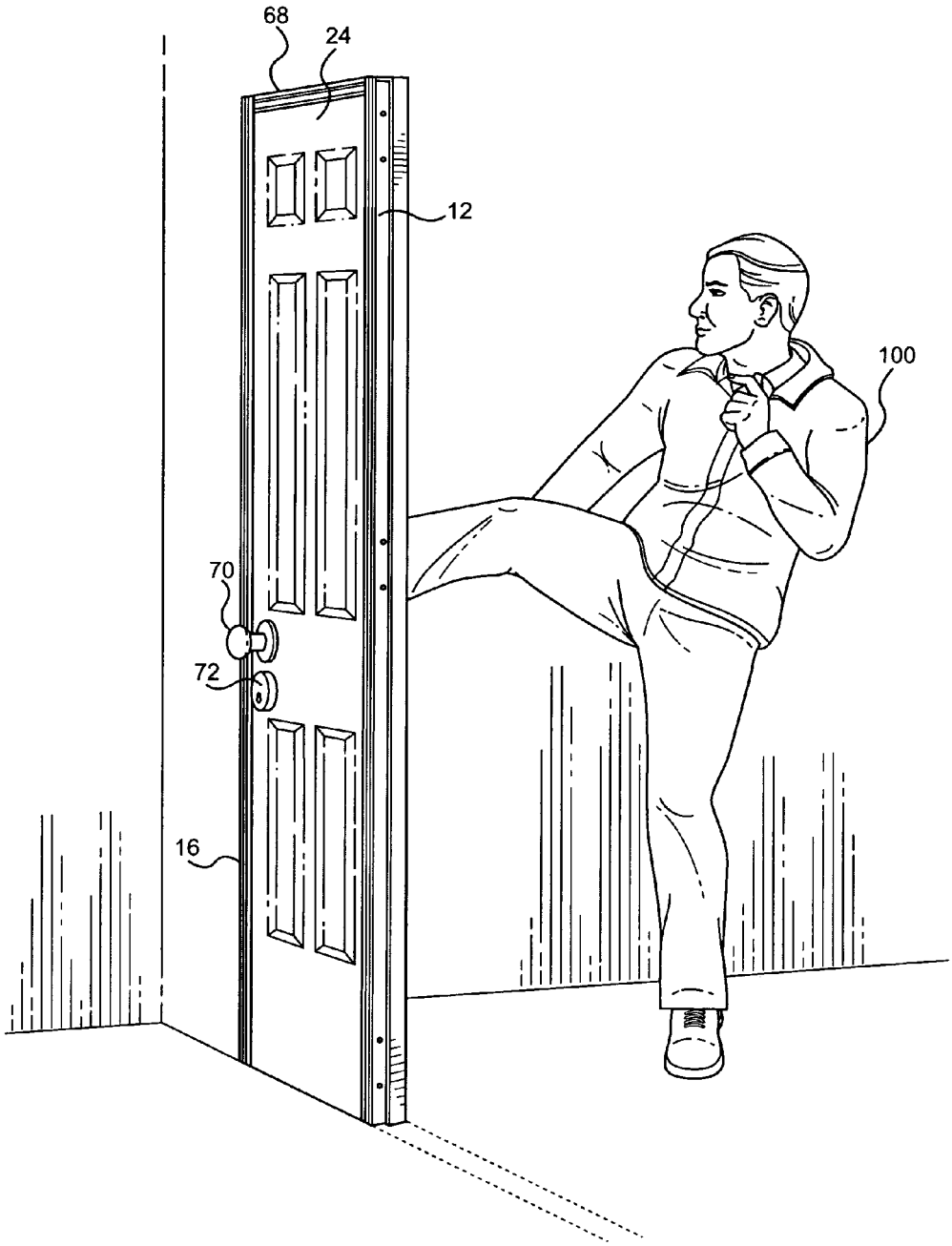
FIG. 7 illustrates a would-be intruder attempting to kick-in the reinforced door according to this invention.

As can be seen in more detail in FIGS. 4-6, the hinge side jamb member 12 comprises a solid body 20 that can be milled from thick wood boards to form two adjacent step-up cutouts or rabbets on one side of the body. The body 20 has an outer surface 21, which faces a door 24, and an inner surface 23, which faces the wall studs 30, 32. The body 20 is rabbet machined or milled to define a first raised stop 22, which abuts the door 24. A first groove 26 is formed along the bottom of the first raised stop 22 to receive the attachment tabs of weather stripping. (not shown). The groove 26 extends transversely to the first raised stop 22 and in a substantially parallel relationship to the inner surface 23 and an outer surface 21.

A second raised stop 28 is formed a distance from the first raised stop 22; the first and second raised stops 22 and 28 can extend parallel to each other. The second raised stop 28 can be rabbet milled, similarly to the first raised stop 22. A second groove 34 is formed at the bottom of the second raised stop 28. The second groove receives an adhesive material and facilitates secure engagement of the jamb member 12 with the reinforcement member 14.

Figure 2:
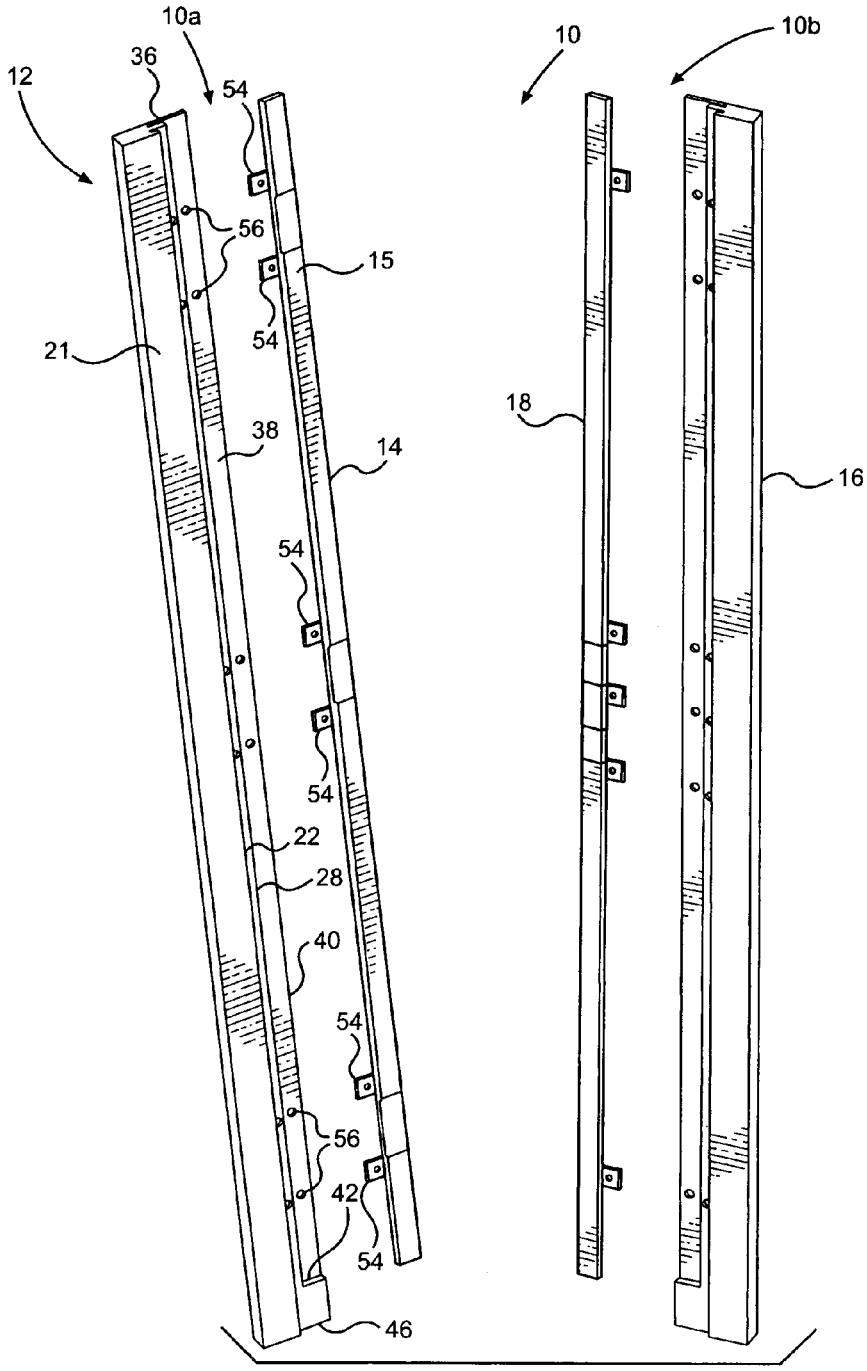
FIG. 2 is a perspective view of the door jambs and a pair of reinforcement members for the hinge and strike sides of the door.

The body 20 defines a first cutout surface 36 located between the raise stops 22 and 28 and a second, deeper cut, cutout surface 38 extending between the second raise stop 28 an outer edge 40 of the body 20. The kerf (width) of the second cutout can be similar or greater than the kerf of the first cutout. An upwardly facing shoulder 42 is formed on the bottom of the second cutout surface 38, as can be seen in FIG. 2. Depending on the height of the existing door and the door frame, the shoulder 42 can be close to the bottom end 46 of the body 20, while the hinge side reinforcement member 14 rests thereon.

The reinforcement member 14 comprises a hollow metal tubular body 15 of a generally rectangular cross-section. In one aspect of the invention, the first reinforcement member 14 is a tube 1.5 inches wide and 0.5 inches thick formed from 16 gauge steel. An insert 48 is tightly fitted into the hollow tube 15, with a configuration substantially matching interior of the tubular member. The insert 48 can be formed from a natural or artificial material. In some aspect of the invention, the insert 48 is formed from 1 5/16"×5/16"×79" rectangular vinyl strip.

The reinforcement member 14 is secured to the body 20 by fitting against the second cutout surface 38 and abutting the second raise stop 28. In some aspect of the invention, the tube 15 is wide enough to substantially cover the second cutout surface 38, from the second raise stop 28 to the outer edge 40 of the body 20. The length of the reinforcement member 14 is substantially equal to the length of the jamb member, extending along almost entire length of the jamb member.

The assembly 10 provides for the use of metal-to-metal fasteners 49, which can be 0.5" long. A long wall fastener 50 secures the body 20 to the building structure. The wall fastener 50 can be 3 5/8" long lag fastener capable of extending through the first rabbet milled portion of the body into the wall studs 30, 32. If necessary, one or more shims 52 can be positioned between the jamb 12 and the wall stud 30. In that case, the wall fastener 50 extends through the shim 30 and then into the wall studs, 30, 32 in a manner shown in FIG. 5.

A plurality of frame clips 54 is secured in a spaced-apart relationship along the length of the tube 15. In the embodiment shown in the drawings, the tube 15 has six frame clips 54 secured to the hinge side of the jamb. The frame clips 54 are secured perpendicular to the elongated reinforcement member 12 and 18. When secured to the hinge side jamb 12, the frame clips 54 are attached above and below each of the hinge plates 56. The metal-to-metal fasteners 49 attach the frame clips 54 to the reinforcement member 14 and 18. The reinforcement members 14, 18 are secured to the jamb bodies 12, 16 using MMA adhesive. In one aspect of the invention, the fasteners 49 are attached to the frame clips 54 and the reinforcement members 14, 18 before the subassembly is place in the jamb bodies 12, 16.

Figure 3:
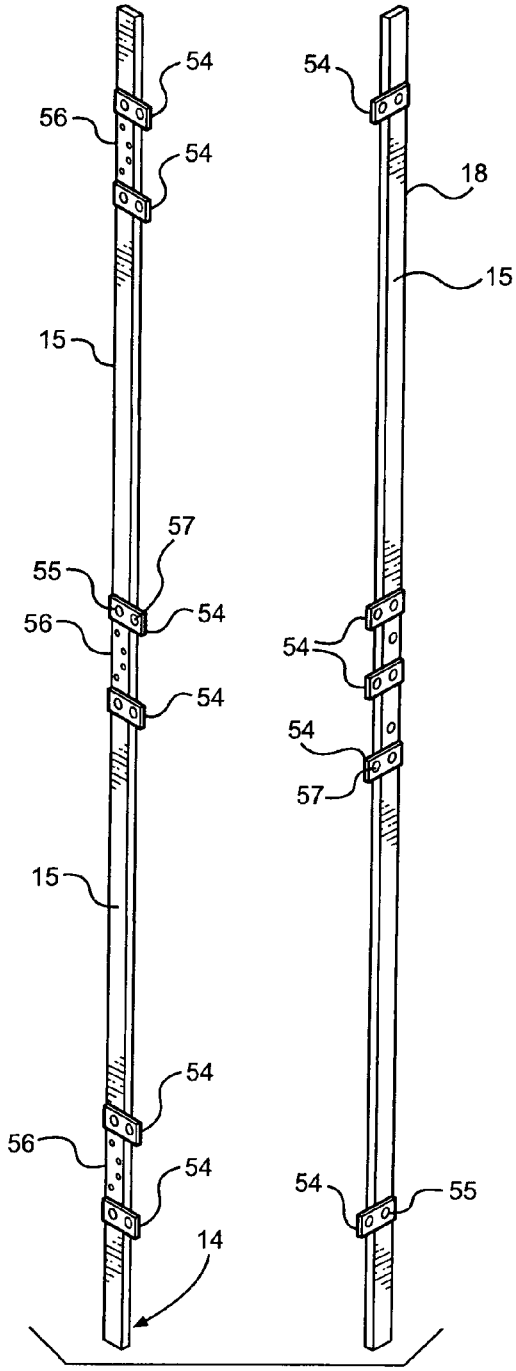
FIG. 3 is a perspective view of the reinforcement members with frame clips.

As can be better seen in FIG. 3, each frame clip 54 comprises a rectangular plate, which can be formed from steel of the same gauge as the tube 15, for instance 16 gauge carbon steel. Each frame clip 54 has a pair of openings 55, 57, through which a fastener is inserted. One fastener is inserted through the opening 55 to secure the frame clip 54 to the tube 15, while another fastener is inserted through the opening 57 to secure the tube 15 to the door jamb 12 through aligned openings 56 formed in the surface 38 of the body 20.

In some aspect of the invention, 3 3/16" beads MMA (Methyl methacrylate) adhesive are applied along the length of the rabbeted face 38 of the hinge and strike side jambs before placing assembled docking component (tube 15) into the milled rabbet.

As discussed above, the structure of the strike side jamb 16 is a minor image of the hinge side jamb 12, and the structure of the strike side reinforcement member 18 is a minor image of the hinge side reinforcement member 14. The only difference is the number of frame clips 54 carried by the second reinforcement member 18. In this case, five frame clips 54 are secured to the tube 15: one frame clip 54 adjacent an upper portion 60 of the tube 15, one frame clip 54—adjacent a lower portion 62 of the tube 15, and three frame clips 54—adjacent a middle portion 64 of the tube 15. The three middle frame clips 54 reinforce the area around the locks 70, 72, which are positioned in the door 24 using pre-drilled openings 65, 67, respectively.

The door frame assembly 10 is designed to be nailed to a wall structure of a building. The wall structure includes a head jamb 68 and above-identified wall studs 30, 32. During installation, the installer prepares a rough door opening, which is measured in height to be equal to the door frame, plus 0.5 inch and width of the door frame, plus ¾". The installer then assembles the hinge and strike jambs to header and threshold. Using #8×3" wood screws, the hinge and strike jambs are fastened to the header jamb 68 and threshold.

Next, the assembled unit is positioned in the rough opening. The hinge and strike side jambs are temporarily secured using finish nails driven through the narrow area concealed behind the weather strip. The installer ensures that the assembly is plumb and level in every direction and if necessary, installs shims at all four corners of the unit after plumbing and leveling. The installer then countersinks and drives 3, #8×3" wood screws along the length of each hinge and strike jamb, continuing to shim at each fastener location to maintain plumbness and flatness of the jambs.

In some aspect of the invention, the installer also installs shims at hinge and strike locations by placing properly sized plywood shims sufficient to take up the space between the jambs and rough opening, directly behind all hinges and strike locations.

After checking the plumb and level, the installer begins to install the door 24. On all hinges, it is suggested to use 2, #12×2½" (or largest allowable by hinge) screws through hinge holes nearest weatherstrip; and 2, #12×1¼" (or largest allowable) screws in other holes. The installer then inserts the lockset and hardware 70, 72. Finally, the long lag screws 50 are driven through the hinge side and strike side jambs until they are fully seated in counter-bored holes (approximately ¼" below the surface of the jamb).

The door reinforcement assembly 10 was tested according to Standard Test Method for Security of Swinging Door Assemblies, ASTM F476. The test equipment included a door ram suspended in a pendulum manner with a steel weight capable of delivering horizontal impacts of up to 200 J (148-lbf). The striking end of the weight had a hemispherical configuration with a diameter of about 6 inches. The door ram used in the tests weighed 99.2 lbs (45 kg).

The wall fixture for the door assembly tests has framing members providing rigid transverse restraint along all four edges of the assembly. The restraint provided by the wall fixture simulated the rigidity normally provided to a door assembly in a building by the ceiling, floor, and walls.

A vertical wall section consisted of 2×4 wall studs, with a rough entry door opening and was covered with 0.5 inch exterior grade plywood on the exterior and with 0.5 inch gypsum board—on the interior, 111 inches wide and 97½ inches high.

Impact Tests

Sequence 1

Bolt Impact Test: 100 impacts at 200 j by the 99.2 lb door ram pendulum weight, where the axis was perpendicular to the face of the door at a point defined by the intersection of a vertical line 8 inches from the lock edge, and a horizontal line from the center of the bolt.

Sequence 2, 3, 4

Hinge Impact Test: Subject each hinge (starting from lowest placed hinge) to 10 impacts at 200 J in the same manner as the bolt impact test at the intersection of a vertical line 8 inches from the hinge edge, and a horizontal line from the center of the hinge.

During these tests, the door reinforcement assembly 10 performed well, withstanding the impact forces that simulated actual force applied by a would-be intruder 100 attempting to kick-in the door 24. The door frame assembly 10 allows impact energy, applied perpendicularly and horizontally to the face of the closed/locked door, to load the lag screws 50 directly and bypass the WPC substrates of the jamb bodies 12, 16.

The door assembly of the present invention utilizes metal tubes 15 permanently docked to WPC (wood, plastic, composite) door jambs. It is intended to restrain, frustrate or delay the commission of break-in crimes through swinging door assemblies. This invention is intended to offer manufacturers a pre-hung docking component that interfaces quickly into existing manufacturing stream and which utilizes manufacturer's own jamb stock as the payloading structure.

It will be understood by those skilled in the art that the measurements discussed above are for illustrative purposes only, and other dimensions can be used for different size doors and entryways. It is envisioned that a door can be sold together with the reinforcement assembly such that an installer can immediately secure an entryway of a building using the reinforced door assembly of this invention.

Many other changes and modifications can be made in the design of the present invention without departing from the spirit thereof. I, therefore, pray that my rights to the present invention be limited only by the scope of the appended claims.

I claim:

1. An assembly for reinforcing a door fitted in an opening formed in a building having vertical wall studs, the assembly comprising:

a first elongated hinge side jamb member mountable lengthwise along a hinge side of the door and a second elongated side jamb member mountable lengthwise along a strike side of the door, each of the hinge side jamb member and the strike side jamb member having a solid body formed with a first cutout and a second cutout adjacent the first cutout, said first cutout defining a first raise stop and the second cutout defining a second raise stop, said hinge side jamb member and the strike side jamb member being securable to the wall studs of the building;

a first elongated reinforcement member securable within the second cutout of the hinge side jamb member and a second elongated reinforcement member securable within the second cutout of the strike side jamb member, each of the first reinforcement member and the second reinforcement member comprising a hollow tubular body having a width substantially equal to a width of the second cutout, and wherein an insert is positioned within said tubular body, said insert comprising a vinyl strip having a pre-determined configuration, which substantially matches an interior of the tubular body.

2. The assembly of claim 1, wherein the hinge side jamb member is a minor image of the strike side jamb member, and the first reinforcement member is a minor image of the second reinforcement member.

3. The assembly of claim 1, the first reinforcement member carrying a plurality of frame clips mountable between the first reinforcement member and the hinge side jamb member.

4. The assembly of claim 1, the second reinforcement member carrying a plurality of frame clips mountable between the second reinforcement member and the strike side jamb member.

5. The assembly of claim 1, wherein said first cutout is provided with a first groove arranged to receive a weather strip therein.

6. The assembly of claim 1, wherein said second cutout is provided with a second groove extending substantially parallel to the first groove, the second groove receiving an adhesive material.

7. The assembly of claim 1, wherein the first reinforcement member extends along substantially entire length of the first hinge side jamb member, and the second reinforcement member extends along substantially entire length of the second strike side jamb member.

8. The assembly of claim 1, wherein the hinge side jamb member and the strike side jamb member are each secured to the wall studs of the building by an elongated fastener extending between the first cutout and the wall studs of the building.

9. An assembly for reinforcing a door fitted in an opening formed in a building having vertical wall studs, the assembly resisting an intrusive force applied to said door, the assembly comprising:

a first elongated hinge side jamb member mountable lengthwise along a hinge side of the door and a second elongated side jamb member mountable lengthwise along a strike side of the door, each of the hinge side jamb member and the strike side jamb member having a solid body formed with a first cutout and a second cutout adjacent the first cutout, said first cutout defining a first raise stop and the second cutout defining a second raise stop, said hinge side jamb member and the strike side jamb member being securable to the wall studs of the building by receiving a fastener extending from the first cutout into the wall studs of the building;

a first elongated tubular reinforcement member securable within the second cutout of the hinge side jamb member and a second elongated tubular reinforcement member securable within the second cutout of the strike side jamb member, each of the first elongated tubular member and the second elongated tubular member having an insert fitted therein, said insert comprising a vinyl strip having a pre-determined configuration, which substantially matches an interior of the tubular member.

10. The assembly of claim 9, wherein the hinge side jamb member is a mirror image of the strike side jamb member, and the first reinforcement member is a minor image of the second reinforcement member.

11. The assembly of claim 9, the first reinforcement member carrying a plurality of frame clips mountable between the first reinforcement member and the hinge side jamb member, and wherein the second reinforcement member carries a plurality of frame clips mountable between the second reinforcement member and the strike side jamb member.

12. The assembly of claim 9, each of the first reinforcement member and the second reinforcement member comprising a hollow body having a width substantially equal to a width of the second cutout.

13. The assembly of claim 9, wherein said first cutout is provided with a first groove arranged to receive a weather strip therein.

14. The assembly of claim 9, wherein said second cutout is provided with a second groove extending substantially parallel to the first groove, the second groove receiving an adhesive material.

15. The assembly of claim 9, wherein the first reinforcement member extends along substantially entire length of the first hinge side jamb member, and the second reinforcement member extends along substantially entire length of the second strike side jamb member.

16. A door assembly fitted in an opening formed in a building having vertical wall studs, the assembly resisting an intrusive force applied to said door, the assembly comprising:

a first elongated hinge side jamb member mountable lengthwise along a hinge side of the door and a second elongated side jamb member mountable lengthwise along a strike side of the door, each of the hinge side jamb member and the strike side jamb member having a solid body formed with a first cutout and a second cutout adjacent the first cutout, said first cutout defining a first raise stop and the second cutout defining a second raise stop, said hinge side jamb member and the strike side jamb member being securable to the wall studs of the building by receiving a threaded fastener extending from the first cutout into the wall studs of the building;

a first elongated tubular reinforcement member securable within the second cutout of the hinge side jamb member and a second elongated tubular reinforcement member securable within the second cutout of the strike side jamb member, each of the first elongated tubular member and the second elongated tubular member having an insert fitted therein;

an insert fitted into each of the first reinforcement member and the second reinforcement member, said insert comprising a vinyl strip having a pre-determined configuration, which substantially matches an interior of the tubular member; and a door swingably mounted between the hinge side jamb member and the strike side jamb member.

17. The assembly of claim 16, wherein the hinge side jamb member is a mirror image of the strike side jamb member, and the first reinforcement member is a minor image of the second reinforcement member.

18. The assembly of claim 16, the first reinforcement member carrying a plurality of frame clips arranged for mounting between the first reinforcement member and the hinge side jamb member, and wherein the second reinforcement member carries a plurality of frame clips arranged for mounting between the second reinforcement member and the strike side jamb member.

19. The assembly of claim 16, each of the first reinforcement member and the second reinforcement member comprising a hollow body having a width substantially equal to a width of the second cutout.

20. The assembly of claim 16, wherein said first cutout is provided with a first groove arranged to receive a weather strip therein.

21. The assembly of claim 20, wherein said second cutout is provided with a second groove extending substantially parallel to the first groove, the second groove receiving an adhesive material.

22. The assembly of claim 16, wherein the first reinforcement member extends along substantially entire length of the first hinge side jamb member, and the second reinforcement member extends along substantially entire length of the second strike side jamb member.

* * * * *